US007121193B2

(12) United States Patent
Balling et al.

(10) Patent No.: US 7,121,193 B2
(45) Date of Patent: Oct. 17, 2006

(54) FLEXIBLE STRAP FEED GUIDE FOR OVERHEAD STRAPPER

(75) Inventors: Richard K. Balling, Cary, IL (US); Rainer Ropers, Lake Zurich, IL (US); Timothy B. Pearson, Antioch, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/051,420

(22) Filed: Feb. 4, 2005

(65) Prior Publication Data

US 2006/0174780 A1 Aug. 10, 2006

(51) Int. Cl.
*B65B 13/04* (2006.01)

(52) U.S. Cl. ..... 100/25; 100/29; 53/589

(58) Field of Classification Search ..... 100/25, 100/26, 29; 53/589
See application file for complete search history.

(56) References Cited

U.S. PATENT DOCUMENTS 3,213,781 A * 10/1965 Collins et al. ..... 100/26
3,279,354 A * 10/1966 Dickens et al. ..... 100/26
5,078,057 A * 1/1992 Pearson ..... 100/25
6,484,476 B1 * 11/2002 Yamamoto et al. ..... 53/399
6,532,722 B1 3/2003 Gerhart et al.
6,543,341 B1 4/2003 Lopez
6,575,086 B1 6/2003 Pearson et al.
6,584,892 B1 7/2003 Flaum et al.
6,629,398 B1 10/2003 Pearson et al.
6,651,550 B1 11/2003 Flaum et al.

* cited by examiner

*Primary Examiner*—Derris H. Banks
*Assistant Examiner*—Jimmy T. Nguyen
(74) *Attorney, Agent, or Firm*—Mark W. Croll, Esq.; Donald J. Breh, Esq.; Levenfeld Pearlstein, LLC

(57) ABSTRACT

A flexible strap guide for an overhead strapper having a feed head for feeding the strapping material from a supply to a strapping head being mounted to a movable platen. The guide includes an elongated flexible spine formed from a plurality of hinged elements. Each of the elements is hingedly connected to and independently movable relative to each adjacent element. The elements define a central channel therein defined by a contiguous inner periphery. A hollow tubular element is positioned within the flexible spine and is flexible with the spine. The tubular element defines a pathway for movement of the strapping material therethrough between feed head and the strapping head. The guide is flexible at points between the feed head and the strapping head and is configured to permit movement of the strapping head upward and downward and to retain the hollow tubular element in an unobstructed condition as the strapping head moves upward and downward. A strapping machine having the flexible strap guide is also disclosed.

10 Claims, 6 Drawing Sheets

FLEXIBLE STRAP FEED GUIDE FOR OVERHEAD STRAPPER

BACKGROUND OF THE INVENTION

The present invention is directed to an overhead strapper. More particularly, the present invention is directed to an improved flexible strap feed guide for an overhead strapper.

Strappers are in widespread use to, for example, position and tension strap material around a load. Strapping loads may be done for a number of reasons. Often, loads are strapped in order to facilitate handling and transport.

Many loads that require strapping are large, oversized loads. Loads may also be compressible. For example, the load may be a large stack of cardboard items or a bale of textile material.

In order to accommodate large or oversized loads, overhead strapping machines are used. One exemplary strapper is disclosed and described in pending U.S. patent application Ser. No. 10/999,084 to Ropers et al., in which the size of the strap chute can be varied by raising and lowering a horizontal platen that carries the upper portion of the strap chute. The platen is brought into close contact with the upper surface of a load prior to strapping to reduce the opportunity for strapper malfunction by maintaining the size (height) of the strap chute only to that required to accommodate the load.

Such a strapper includes a frame, an upper horizontally oriented platen mounted to the frame for vertical movement along the frame and a modular strapping head mounted to the platen and movable therewith. A modular feed head is fixedly mounted to the frame, spaced from the strapping head and stationary relative to the platen. A strap guide is mounted in part to the frame and in part to the platen. The strap guide provides a varying length pathway from the feed head to the strapping head.

In this strapper, the strap guide is formed from a plurality of pairs of discrete wall portions (tile-like elements) that move or pivot between a closed configuration to retain the strap within the pathway and an open configuration in which the strap is released from the pathway. The pairs of discrete wall portions are biased inwardly to the closed position. A turning assembly is mounted for movement with the platen and cooperates with the strap guide to redirect the strap as the strap exits from the pathway to the strapping head and an extension portion extends from the turning assembly to the strapping head. The vertical portion of the guide has a varying height strap path dependent upon the vertical position of the upper horizontally oriented platen. The varying height is provided by the discrete wall portions that close to form the strap guide or chute and open to release the strap.

While this arrangement functions well, in certain instances, the height of the vertical guide portion may be to high. That is, there may be instances in which although the elevated strapper height is needed, it may be desirable to lower or reduce the height of the vertical guide portion.

Accordingly, there is a need for an overhead strapping machine that uses a relocated feed head (off of the overhead platen), that incorporates a reduced height required vertical guide portion. Desirably, such a machine includes a simplified flexible guide arrangement that permits varying the height at which the platen can reside during machine operations.

BRIEF SUMMARY OF THE INVENTION

A flexible strap guide is configured for use in an overhead strapper. The strapper is of the type for feed a strapping material around a load, positioning, tensioning and sealing the strapping material around the load. The strapper has a movable platen having a strapping head mounted to the platen for movement with the platen. A feed head for feeding the strapping material from a supply to the strapping head is fixedly mounted at about grade level and is spaced from the strapping head.

The guide extends between the feed head and the strapping head. The guide includes an elongated flexible spine formed from a plurality of hinged elements. Each of the elements is hingedly connected to and independently movable relative to each adjacent element. The elements define a central channel therein defined by a contiguous periphery.

A hollow tubular element is positioned within the flexible spine and is flexible with the spine. The tubular element defines a pathway for movement of the strapping material therethrough between the feed head and the strapping head.

The guide is mounted at one end at about the feed head and at another end at about the strapping head. The guide is flexible at points between the feed head and the strapping head. The guide is configured to permit movement of the strapping head upward and downward and to retain the hollow tubular element in an unobstructed condition as the strapping head moves upward and downward.

The guide is formed having a pair of side walls each wall having a hinge ear and an ear receiver. The hinge ear of each element is operably connected to the ear receiver of an adjacent element and the ear receiver of that element is operably connected to the hinge ear of an opposite adjacent element.

Each hinged element includes front rungs extending between corresponding front edges of each hinged element and rear rungs extending between corresponding rear edges of each hinged element. In this manner, the spine has a ladder-like configuration for viewing the tubular element in the central channel.

Preferably, the front or rear rungs are fixed and the other (front or rear) rungs are hingedly mounted to one of the side walls and lockingly connected to the other of the side walls so that the spine can be opened. In a present arrangement, a portion of the guide is mounted to a vertical riser adjacent to the feed head. A strapping machine having the flexible guide is also disclosed.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

While the present invention is susceptible of embodiment in various forms, there is shown in the photograph and drawings and will hereinafter be described a presently preferred embodiment with the understanding that the present disclosure is to be considered an exemplification of the invention and is not intended to limit the invention to the specific embodiment illustrated.

It should be understood that the title of this section of this specification, namely, "Detailed Description Of The Invention", relates to a requirement of the United States Patent Office, and does not imply, nor should be inferred to limit the subject matter disclosed herein.

Figure 1:
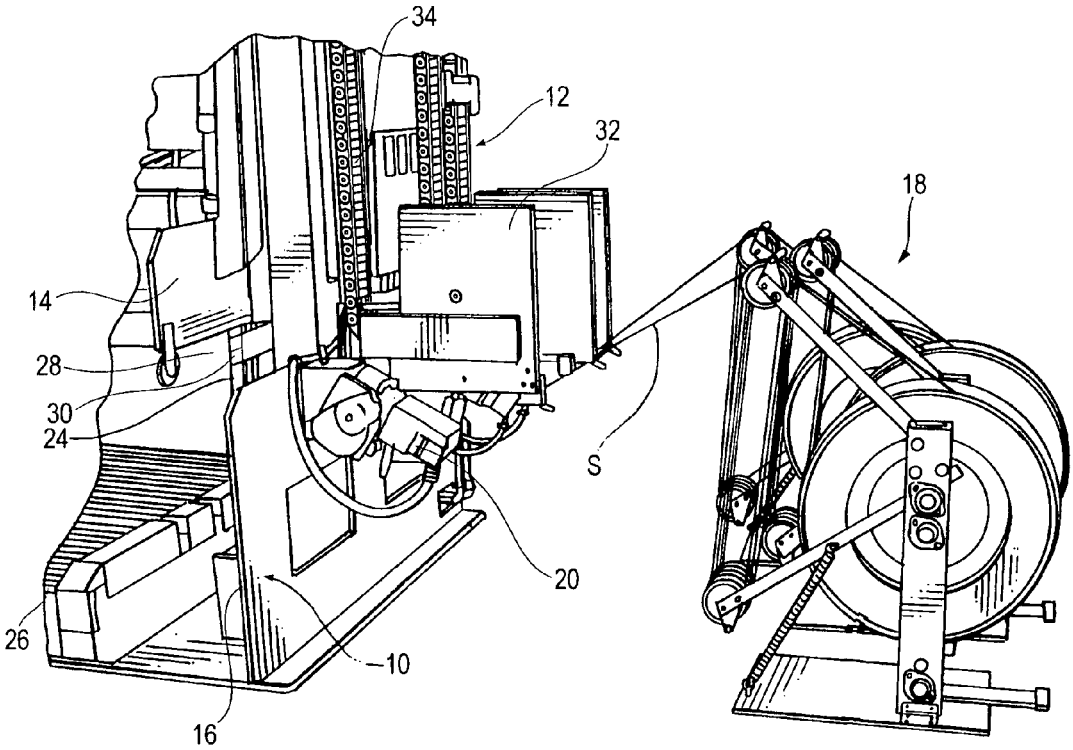
FIG. 1 is a front perspective view of an overhead strapper having a feed assembly embodying the principles of the present invention, the strapper being shown with a dispenser for feeding strap material.
Figure 2:
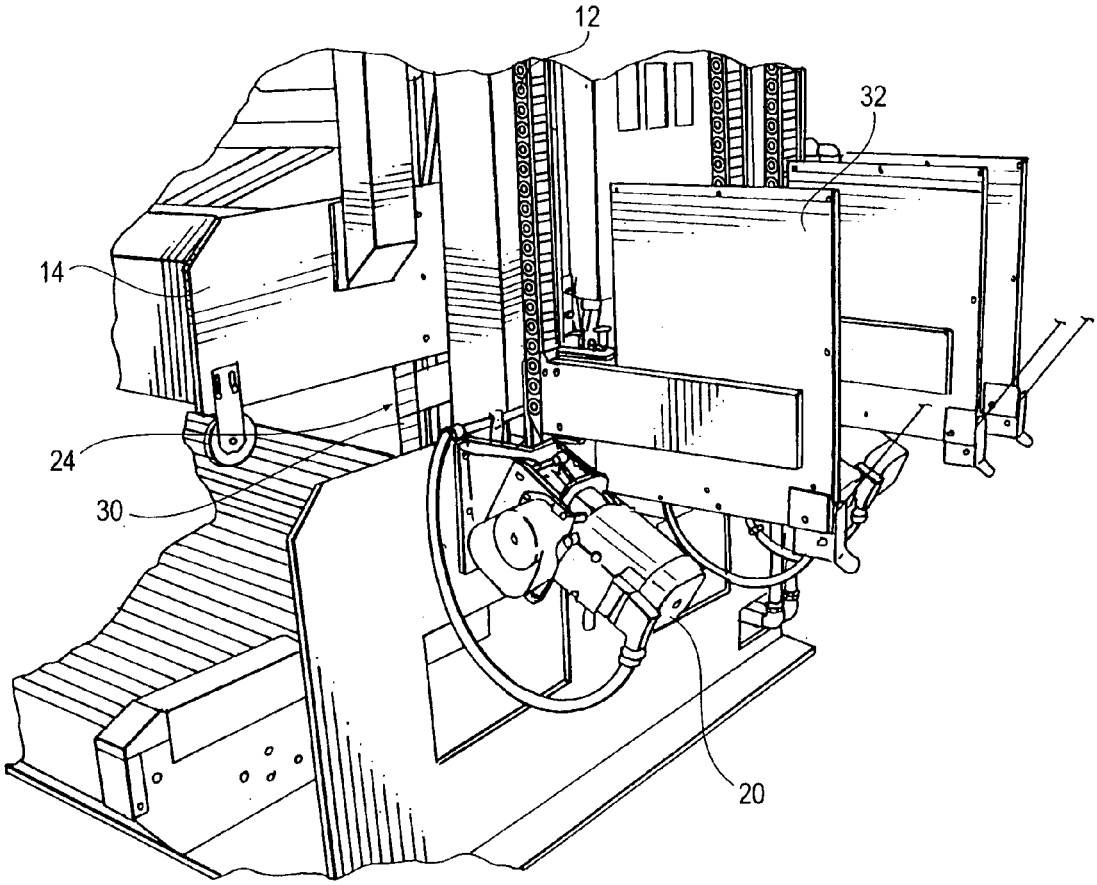
FIG. 2 is an enlarged view of the strapper showing the feed head and feed assembly.
Figure 3:
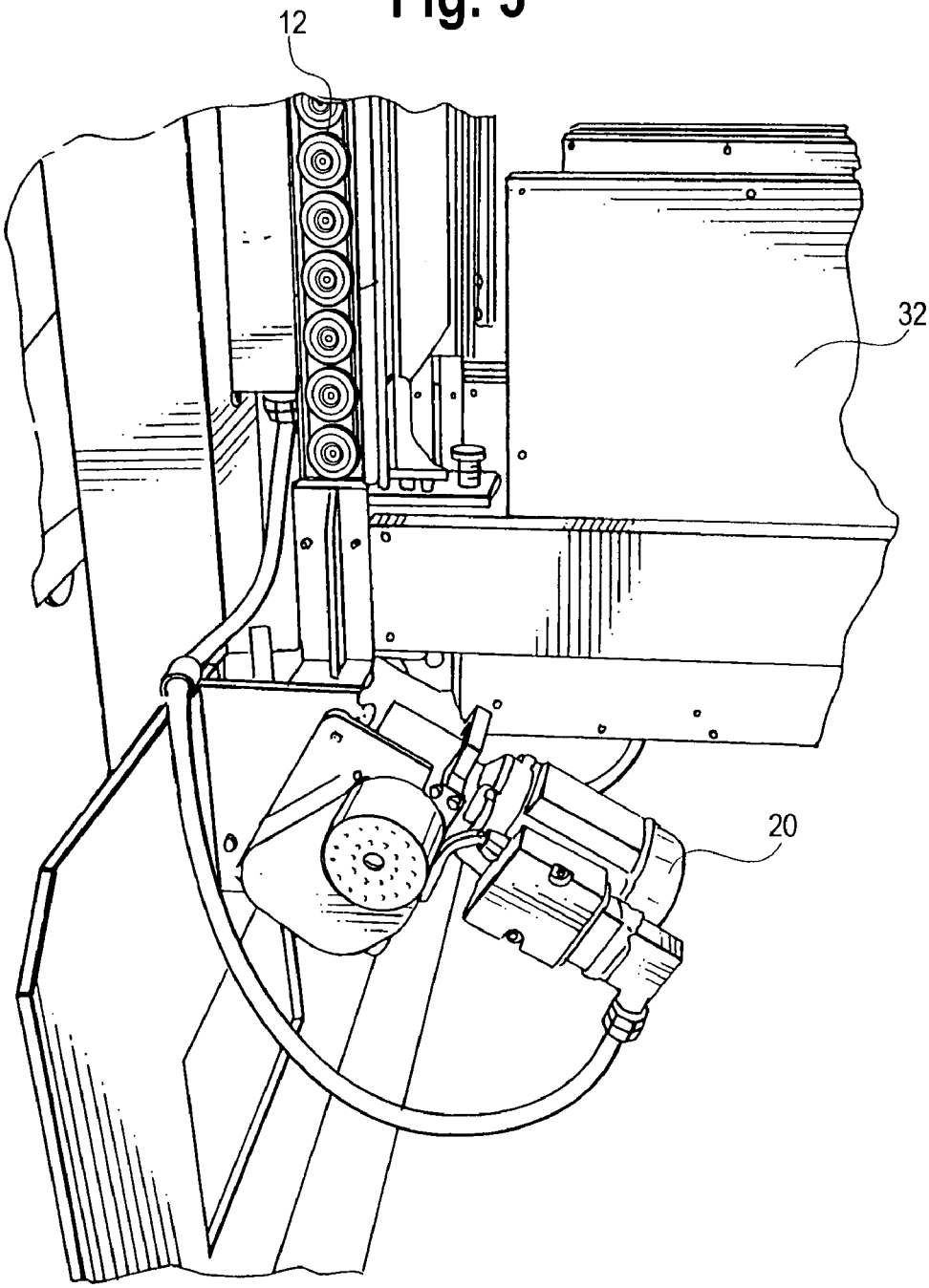
FIG. 3 is another enlarged view of the strapper showing the guide mounted above the feed head.

Referring now to the figures and in particular to FIGS. 1 and 2, there is shown a strapper 10 having an improved strap feed guide 12 embodying the principles of the present invention. The feed guide 12 is configured for use with an overhead strapper 10 in which the strapping function is carried out at the top of, or over the strapped load L.

The strapper 10 includes an upper platen 14 that is raised and lowered to accommodate loads of differing heights. The strapper 10 includes generally, a frame 16, a strap material dispenser 18, the strap feed guide 12, a feed head 20, and a strapping head 22. A strap chute 24 is formed between the platen 14, a lower load carrying surface 26 and includes vertical side chute portions 28 that extend between the lower surface 26 and the platen 14.

The strap chute vertical side portions 28 are formed having a tiled wall arrangement that permits varying the height of the vertical guide portion. The tiles 30 are spring biased inwardly to define the strap pathway and can be urged outwardly to open the pathway to permit the strap to exit the chute as when the strap is tensioned around the load. Such an arrangement is more fully disclosed in the aforementioned U.S. patent application to Ropers et al. The tiled arrangement forms discrete strap chute wall portions through which the strap is fed. In this manner, with the tiles 30 oriented inward, the pathway is fully defined, but when the tiles are urged outward, the strap can exit the pathway.

In the present strapper, the feed and strapping heads 20, 22 are separate and spaced from one another with the strapping head or sealing head 22 located on the (horizontal) platen 14 that is raised and lowered to accommodate the differing load heights. Preferably, the heads 20, 22 are modular, in an arrangement similar to that disclosed in Flaum et al., U.S. Pat. No. 6,584,892, which patent is commonly assigned with the present application and is incorporated herein by reference. Advantageously, this positions the strapping head 22 proximal to, and in fact just above, the load and the feed head 20 at a convenient location (discussed below) separate from the strapping head 22. The strapping head 22 is that portion of the strapper 10 through which the strap S traverses into and out of the strap chute 24, and at which the strap material S is sealed onto itself (as by welding) and severed from the strap supply (dispenser 18 feed).

The feed head 20, which is that portion of the strapper 10 that draws the strap S material from the dispenser 18, feeds the strap material through the guide 12 to the strapping head 22, into and around the strap chute 24, and back to the strapping head 22, is mounted at a stationary location, at about grade level at a side of the strapper 10. This facilitates maintenance of the feed head 20. The present strapper 10 includes a slack box 32 adjacent to the feed head 20, into which strap S is fed or pulled from the dispenser 18. The slack box 32 provides a supply of readily available strap material S for the feed head 20 without excessive resistance and without running out the material on the dispenser 18.

Figure 4:
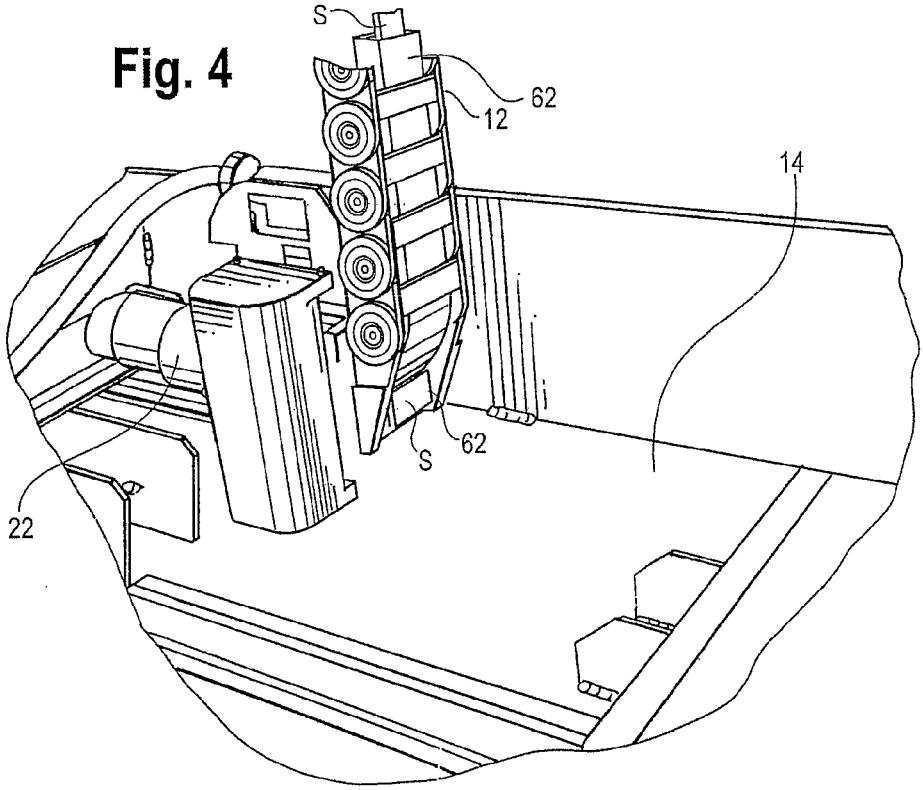
FIG. 4 illustrates the guide terminating at the strapping head located on the platen.
Figure 5:
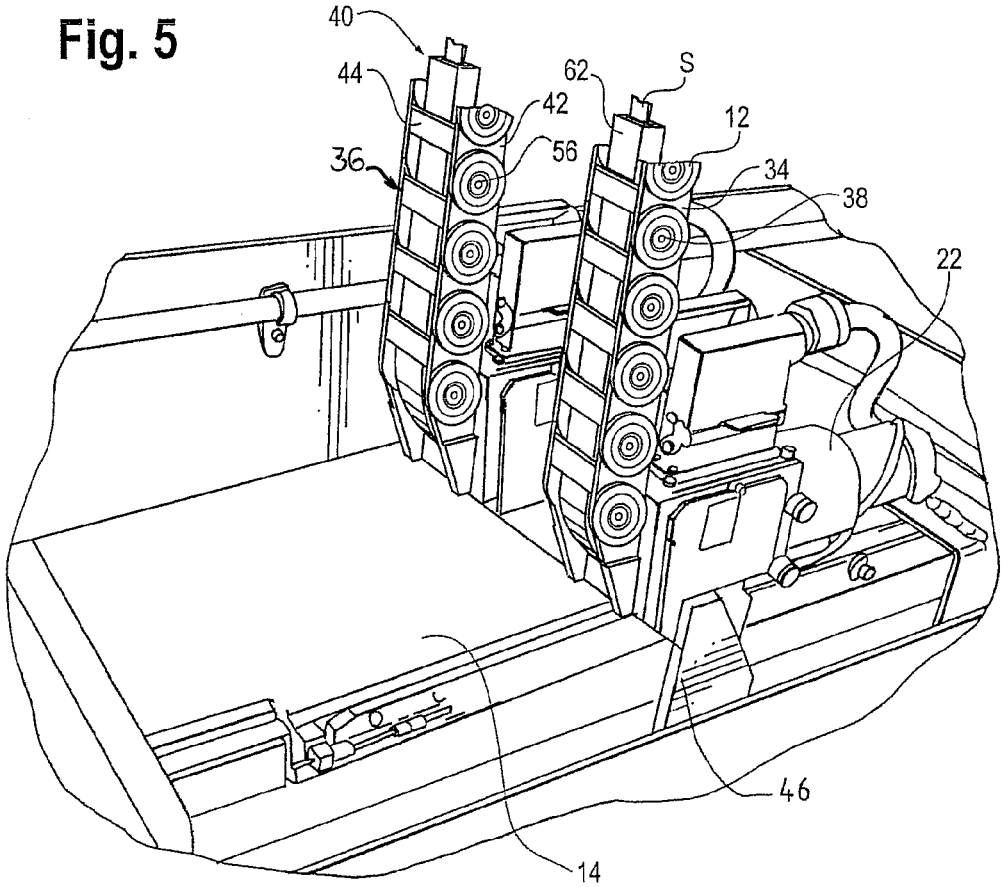
FIG. 5 is another illustration of (a pair of) guides terminated at the strapping head(s)

Unlike known machines, the present strapper includes a flexible guide portion 12 through which the strap material S is fed from the feed head 20 to the strapping head 22. The flexible guide 12 includes an outer spine 34 formed from a plurality of hinged rigid elements 36, each mounted to adjacent elements 36 by a pivoting hinge arrangement 38. The guide 12, at a lower region (see 12*a*), is affixed to a vertical portion 17 of the frame 16. The elements 36, when stacked together have a flexible ladder-like form (see, for example, FIGS. 4 and 5) that defines an inner open channel 40 that is protected by the rigid elements 36. Each element 36 includes a pair of side walls 42 a front rung wall 44 and a rear rung wall 46. The rung walls 44, 46 extend only a portion of the height of each element 36 and in this manner permit visible inspection and viewing of the central channel 40 of the flexible guide 12. This arrangement also permits flexing or bending the guide 12 without interference from the walls 42, 44 contacting one another.

Figure 6:
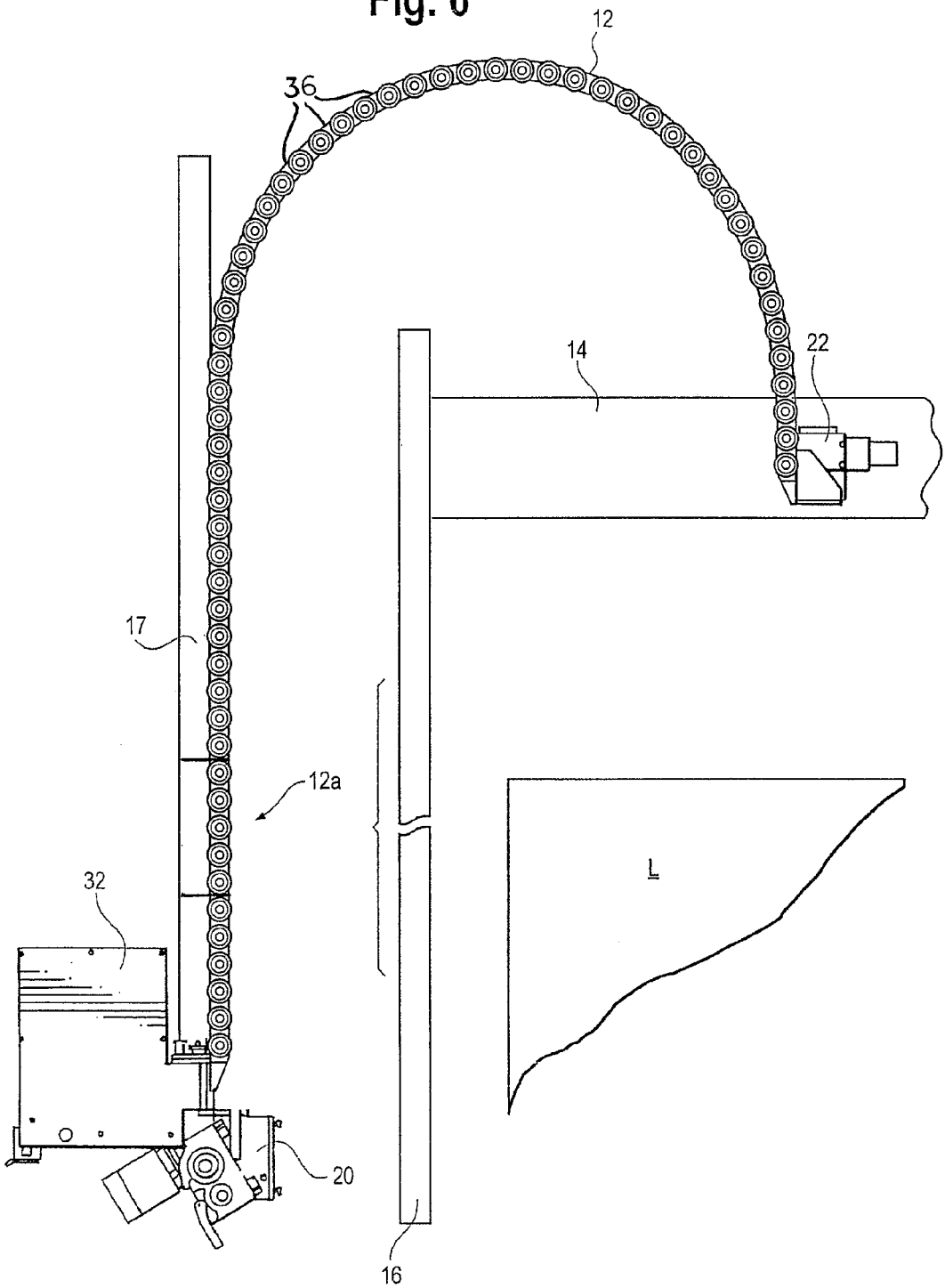
FIG. 6 is a schematic side view illustration of the guide as it extends between the feed head (at a fixed end) and the strapping head (at a moving end)
Figure 7:
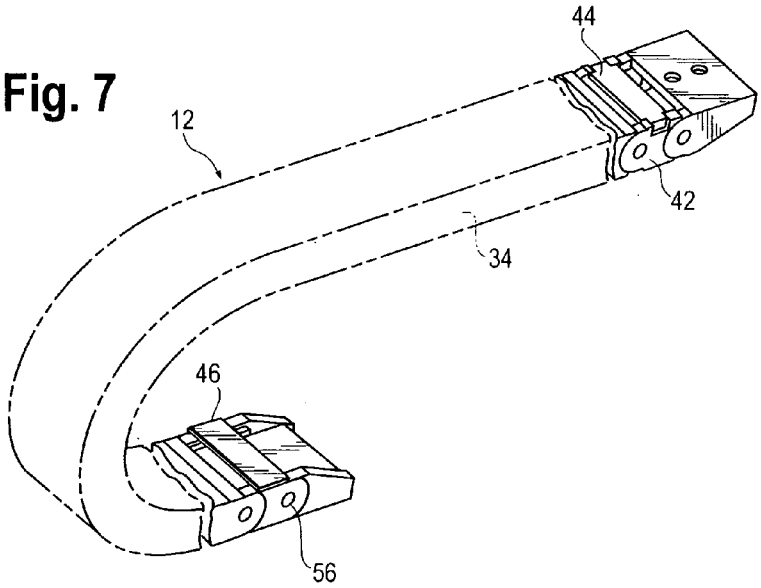
FIG. 7 is a perspective illustration of the guide flexible spine.
Figure 8:
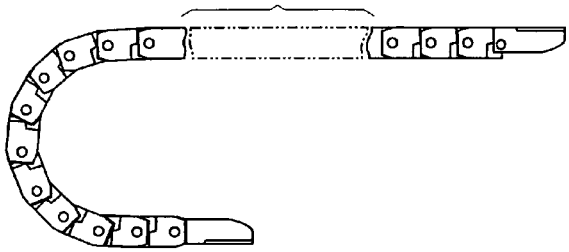
FIG. 8 is a side view of the spine.

The spine 34 is configured so that it can be flexed but not bent so much as to form a sharp or acute bend; rather, the flexing provides a curved or rolled profile as best seen in FIG. 6. In a present embodiment, the spine 34 is formed from a non-metallic cable and hose carrier, such as that commercially available from KabelSchlepp America, Inc. of Milwaukee, Wis., under the tradenames MICROTRAK, PLASITRACK or VERSATRAX cable and hose carrier.

Figure 9:
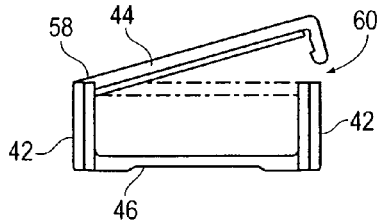
FIG. 9 is a cross-sectional view of one of the spine elements showing a hinged arrangement.
Figure 10A:
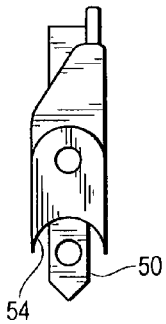
FIGS. 10A and 10B show two of the elements illustrating the element ear and ear receiver.
Figure 10B:
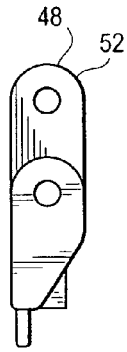

Each side wall 42 includes upper and lower hinge portions 48, 50 that interleaf with adjacent side portions. An upper hinge portion 48 includes a semi-circular wall profile or hinge ear (as indicated at 52) that mates with (an adjacent) lower wall recessed region or ear receiver 54. The semi-circular wall 52 and recessed regions 54 fit together such that the wall 52 rotates within the recess 54. A pin 56 extends through the wall 52 and recess 54 to provide a hinge pintle. In one embodiment (as seen in FIG. 9), the front or rear rung walls 44, 46 are mounted to one of the side walls 42 by, for example, a living hinge 58, and securable to the other wall by a snap-type arrangement 60 (e.g., a biased detent that fits into an opening) so that the spine 34 can be opened to access the channel 40 and closed to "seal" the channel 40.

In a present embodiment, the guide 12 includes a rectangular tube 62 that extends through the spine channel 40. The tube 62 serves a sheath for the strap material S to protect the material S from damage and to provide a smooth, low friction path for feeding the strap material S. In this manner, the number and extent of possible interferences through the strap guide 12 are significantly limited. And, with the rectangular tube 62 used in conjunction with the spine 34, the strap S is provided with a path that is flexible, yet cannot be formed (bent) so much as to form a bend so sharp as to interfere with feeding the strap S through guide 12.

All patents referred to herein, are hereby incorporated herein by reference, whether or not specifically done so within the text of this disclosure.

In the disclosures, the words "a" or "an" are to be taken to include both the singular and the plural. Conversely, any reference to plural items shall, where appropriate, include the singular.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A flexible strap guide for an overhead strapper of the type for feed a strapping material around a load, positioning, tensioning and sealing the strapping material around the load, the overhead strapper having a feed head for feeding the strapping material from a supply to a strapping head, the feed head being stationary and spaced from a strapping head, the strapping head being mounted to a movable platen, the guide extending between the feed head and the strapping head, the guide comprising:

an elongated flexible spine formed from a plurality of hinged elements, each of the elements being hingedly connected to and independently movable relative to each adjacent element, the elements defining a central channel therein defined by a contiguous periphery;

a hollow tubular element positioned within the flexible spine and being flexible with the spine, the tubular element defining a pathway for movement of the strapping material therethrough between the feed head and the strapping head, wherein the guide is mounted at one end at about the feed head and at another end at about the strapping head, the guide being flexible at points between the feed head and the strapping head, the guide configured to permit movement of the strapping head upward and downward and to retain the hollow tubular element in an unobstructed condition as the strapping head moves upward and downward.

2. The strap guide in accordance with claim 1 wherein each hinged element is formed having a pair of side walls each having a hinge ear and an ear receiver, the hinge ear of each element being operably connected to the ear receiver of an adjacent element and the ear receiver being operably connected to the hinge ear of an opposite adjacent element.

3. The strap guide in accordance with claim 2 wherein each hinged element includes a front rung extending between corresponding front edges of each hinged element and a rear rung extending between corresponding rear edges of each hinged element.

4. The strap guide in accordance with claim 3 wherein one of the front and rear rungs is fixed to the side walls and the other rung is hingedly mounted to one of the side walls and lockingly connected to the other side wall.

5. The strap guide in accordance with claim 1 including a fixed vertical riser portion wherein a portion of the guide is mounted to the fixed vertical portion adjacent the feed head.

6. An overhead strapper of the type for feeding a strapping material around a load, positioning, tensioning and sealing the strapping material around the load, the strapping machine comprising:

a frame;

an upper horizontally oriented platen mounted to the frame for vertical movement along the frame, the platen having a strapping head mounted thereto movable with the platen;

a feed head fixedly mounted to the frame, spaced from the strapping head;

a strap guide mounted in part to the frame at about the feed head and in part to the platen at about the strapping head, the strap guide providing a fixed length flexible pathway from the feed head to the strapping head, the strap guide being formed from an elongated flexible spine formed from a plurality of hinged elements, each of the elements being hingedly connected to and independently movable relative to each adjacent element, the elements defining a central channel therein defined by a contiguous periphery and a hollow tubular element positioned within the flexible spine and being flexible with the spine, the tubular element defining a pathway for movement of the strapping material therethrough between the feed head and the strapping head, wherein the guide is flexible at points between the feed head and the strapping head and is configured to permit movement of the strapping head upward and downward and to retain the hollow tubular element in an unobstructed condition as the strapping head moves upward and downward.

7. The overhead strapper in accordance with claim 6 wherein each hinged element is formed having a pair of side walls each having a hinge ear and an ear receiver, the hinge ear of each element being operably connected to the ear receiver of an adjacent element and the ear receiver being operably connected to the hinge ear of an opposite adjacent element.

8. The overhead strapper in accordance with claim 7 wherein each hinged element includes a front rung extending between corresponding front edges of each hinged element and a rear rung extending between corresponding rear edges of each hinged element.

9. The overhead strapper in accordance with claim 8 wherein one of the front and rear rungs is fixed to the side walls and the other rung is hingedly mounted to one of the side walls and lockingly connected to the other side wall.

10. The overhead strapper in accordance with claim 6 including a fixed vertical portion, wherein a portion of the guide is mounted to the fixed vertical portion adjacent the feed head.

* * * * *

UNITED STATES PATENT AND TRADEMARK OFFICE

CERTIFICATE OF CORRECTION

PATENT NO. : 7,121,193 B2
APPLICATION NO. : 11/051420
DATED : October 17, 2006
INVENTOR(S) : Balling et al.

It is certified that error appears in the above-identified patent and that said Letters Patent is hereby corrected as shown below:

Claim 5, line 4 should read:

--fixed vertical portion wherein a portion of the guide is--

Signed and Sealed this

Nineteenth Day of December, 2006

JON W. DUDAS
*Director of the United States Patent and Trademark Office*